US006634294B2

(12) United States Patent
Boucher et al.

(10) Patent No.: US 6,634,294 B2
(45) Date of Patent: Oct. 21, 2003

(54) DEVICE FOR REDUCING PRINTING SLEEVE NOISE

(75) Inventors: Ronald Henry Boucher, Goffstown, NH (US); Robert Richard Murray, Madbury, NH (US); John Sheridan Richards, Barrington, NH (US); Dan Alan Thomas, Broomsburry, PA (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/997,027

(22) Filed: Nov. 28, 2001

(65) Prior Publication Data

US 2002/0035934 A1 Mar. 28, 2002

Related U.S. Application Data

(62) Division of application No. 09/552,094, filed on Apr. 19, 2000, now Pat. No. 6,347,586.

(51) Int. Cl.[7] ..... B41F 27/00
(52) U.S. Cl. ..... 101/382.1; 101/217
(58) Field of Search ..... 101/375, 376, 101/378, 382.1, 383, 415.1, 217

(56) References Cited

U.S. PATENT DOCUMENTS

| | | | | | |
|---|---|---|---|---|---|
| 1,984,115 | A | * | 12/1934 | Cooper | 101/375 |
| 2,987,994 | A | * | 6/1961 | Allison | 101/375 |
| 3,739,722 | A | * | 6/1973 | Zottoli | 101/375 |
| 4,089,265 | A | * | 5/1978 | White et al. | 101/375 |
| 5,215,013 | A | * | 6/1993 | Vrotacoe et al. | 101/217 |
| 5,513,568 | A | * | 5/1996 | Hoffman et al. | 101/375 |
| 5,601,020 | A | * | 2/1997 | Dawley et al. | 101/217 |

* cited by examiner

*Primary Examiner*—Ren Yan
(74) *Attorney, Agent, or Firm*—Davidson, Davidson & Kappel, LLC

(57) ABSTRACT

A printing press comprises a cylinder having an outer surface and a plurality of air holes for providing air to the outer surface. A sound-damping material is located on a section of the outer surface and an axially-removable printing sleeve fits over the outer surface. Also disclosed is a method for reducing noise from a printing press comprising the steps of providing air through air holes in a cylinder having a free end to aid in placement or removal of an axially-removable printing sleeve, and providing a sound-damping surface to an outer surface of the cylinder at the free end.

8 Claims, 3 Drawing Sheets

DEVICE FOR REDUCING PRINTING SLEEVE NOISE

CROSS-REFERENCE TO RELATED APPLICATIONS

This application is a divisional of U.S. patent application Ser. No. 09/552,094 filed on Apr. 19, 2000 now U.S. Pat. No. 6,347,586.

BACKGROUND OF THE INVENTION

1. Field of the Invention

The present invention relates generally to printing presses and more particularly to reducing noise associated with printing sleeves of printing presses.

2. Background Information

Printing forms in tubular shape, also known as printing sleeves, have been used in a variety of printing applications. For example, printing sleeves used as printing blankets for offset printing are known, as are printing sleeves for flexographic printing. These sleeves typically are slid axially over a respective cylinder with the aid of compressed air exiting from holes in the outer surface of the cylinder. The compressed air helps to expand the sleeve to ease the placement or removal of the sleeve over the cylinder. However, the compressed air also can create a whistle or noise, which may be desirable to reduce.

It is desirable to have a taper at the end of the cylinder to help start the installation of the printing sleeve over the cylinder. This taper has been found to increase the whistle or noise. Removal of the taper can help reduce the noise but makes sleeve installation more difficult.

U.S. Pat. No. 5,215,213 discloses a tubular printing blanket with a damping ring for placement on the inside of a blanket. The damping ring purportedly damps vibrations of the sleeve caused by pressurized flow of air and reduces the resultant noise. The printing blanket fits axially over a blanket cylinder with a continuous outer surface having air holes and a tapered edge surface.

The device of the '213 patent has several disadvantages, including: (1) that a damping ring is required to be placed on every sleeve, so that the costs of each sleeve are increased; and (2) that the damping ring has been found to not reduce noise levels for every axial location of the sleeve as the sleeve is slid over a respective cylinder, i.e. that the escaping air still creates noise as the sleeve is being slid on, and only adequately reduces noise when the blanket is placed fully over the cylinder. Thus noise still results during an axial sliding operation even with the damping rings.

BRIEF SUMMARY OF THE INVENTION

An object of the present invention is to reduce noise associated with the axial removal and placement of printing sleeves.

A preferred embodiment of the present invention provides a printing press comprising a cylinder having an outer surface and a plurality of air holes for providing air to the outer surface, a sound-damping material located on a section of the outer surface, and an axially-removable printing sleeve for fitting over the outer surface of the cylinder.

Advantageously, by having the sound deadening material on the outer surface of the cylinder, the sleeve itself need not have any damping material. Moreover, noise may be reduced even as the sleeve is being removed.

Preferably, the sound dampening material contacts the printing sleeve during the axial removal of the printing sleeve.

The printing press may be an offset lithographic printing press and the printing sleeve a blanket.

The sound-damping material preferably is made of FLOCKBAND manufactured by Rolf Meyer GmbH and available in the U.S. through the supplier International Knife and Saw, Inc. The material may be, for example, 2 to 3 mm in height with a width of 16 mm, and, before placement on the cylinder, has a substrate with adhesive tape and a removable backing. The hook portion (as opposed to the loop portion) of VELCRO tape is also a preferred sound-damping material.

The cylinder outer surface preferably includes a first section at a free end of the cylinder having a first outer diameter, the free end being opposite an end cantileverable in a gear-side frame. The first outer diameter preferably is smaller than a second section of the outer surface having a second diameter, the second section contacting an inner surface of the printing sleeve. This dual diameter arrangement of the cylinder advantageously permits easier placement of the sleeve over the cylinder, since the first reduced diameter section can act as a guide for the sleeve. The air holes may be located at a third section of the outer surface.

An alternate embodiment of the present invention includes a printing press comprising a cylinder having an outer surface, a plurality of air holes for providing air to the outer surface, and a free end, the outer surface having a threaded or roughened section at the free end, and an axially-removable printing sleeve for fitting over the outer surface. The roughened or threaded section is for reducing noise emanating from the printing press.

The present invention also provides a method for reducing noise from a printing press comprising the steps of:

providing air through air holes in a cylinder having a free end to aid in placement or removal of an axially-removable printing sleeve; and providing a sound-damping surface to an outer surface of the cylinder at the free end.

A free end as defined herein is an end which may be free during a cantilevering operation. The free end may or may not be supported during a normal printing operation.

BRIEF DESCRIPTION OF THE DRAWINGS

Two embodiments of the present invention are described below by reference to the following drawings, in which.

DETAILED DESCRIPTION

Figure 1:
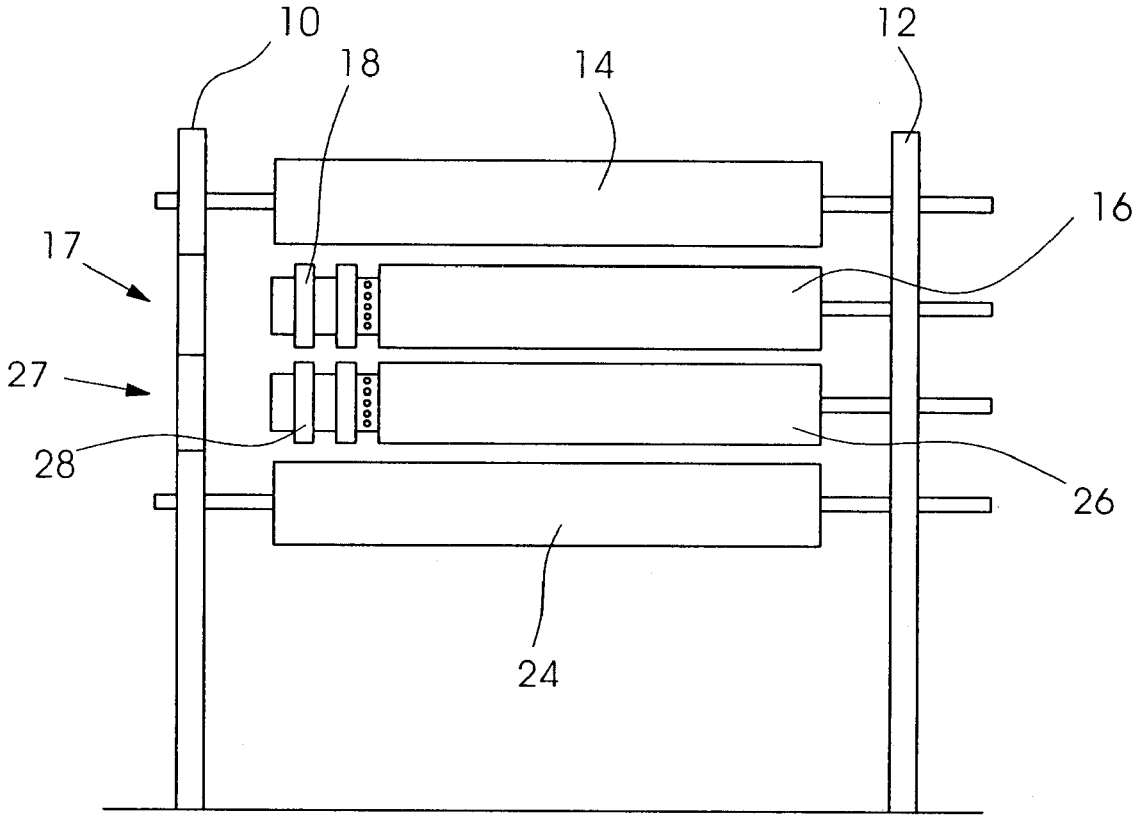
FIG. 1 shows a schematized view of an offset printing press according to the present invention.

FIG. 1 shows a schematized view of an offset printing press according to the present invention, having a work side frame 10, a gear side frame 12, and a first plate cylinder 14 and second plate cylinder 24 supported between the work side frame 10 and gear side frame 12.

The printing press also includes a first blanket cylinder 16 and second blanket cylinder 26, each being supported at one end by gear side frame 12. At the other end the blanket cylinders 16, 26 are releasably supported, for example by bearings in doors of work side frame 10. The doors can open to provide an opening through which a blanket sleeve can be axially slid. While the doors are open, the blanket cylinders 16, 26 may be supported in cantilevered fashion by gear side frame 12, and also may separate from neighboring cylinders to provide clearance for the blanket.

U.S. Pat. No. 5,215,213, which is assigned to the same assignee of the present application, describes a motor for driving an offset printing press and is hereby incorporated be reference herein. U.S. Pat. No. 5,678,485, also assigned to the same assignee of the present application, describes a cantileverable blanket cylinder and is also hereby incorporated by reference herein.

Blanket cylinders 16, 26 have free ends 17, 27 which are unsupported when the doors are opened. At the free ends 17, 27 at an outer surface of the blankets is, respectively, a sound-damping material 18, 28. Sound-damping material 18 preferably extends in strip fashion around the entire circumference of blanket cylinder 16.

Figure 2:
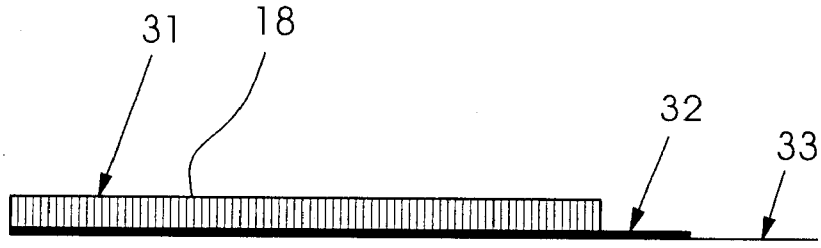
FIG. 2 shows one type of sound-damping material for use with the embodiment of FIG. 1.

As shown in FIG. 2, sound-damping material 18 before attachment to cylinder 16 may be a strip 31 including an outer layer of sound-damping material 18, such as FLOCKBOND, manufactured by Rolf Meyer GmbH and available from International Knife and Saw, Inc. Strip 31 also includes a substrate 32 with adhesive tape, and a removable backing 33 for the adhesive tape. After removing the backing 33, strip 31 thus may be placed manually at a free end of a cylinder.

Figure 3:
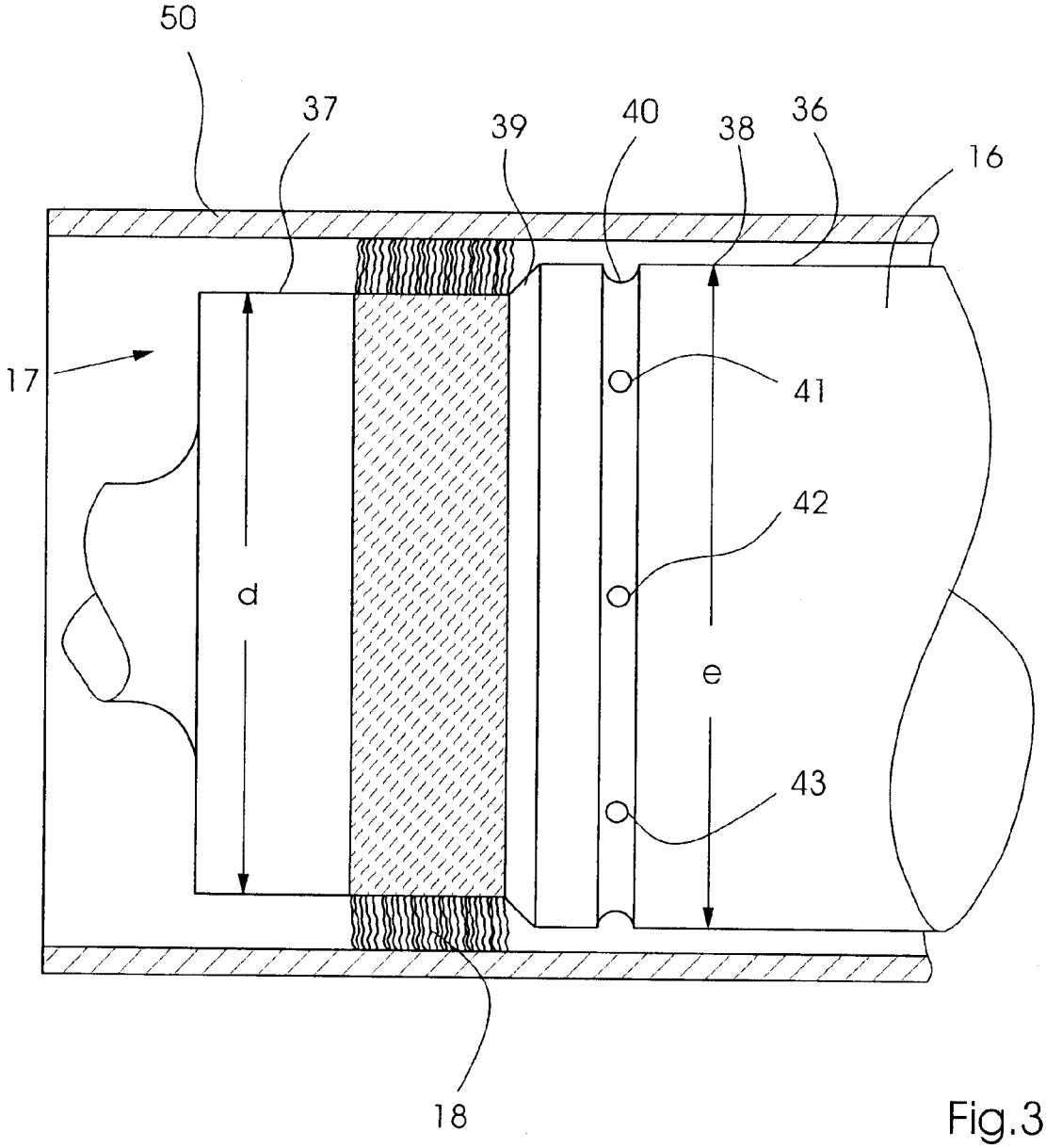
FIG. 3 shows a side view of one embodiment of the printing press of according to the present invention.

FIG. 3 shows the details blanket cylinder 16 in more detail. Blanket cylinder 16 has an outer surface 36 with a first section 37 having a diameter d and a second section 38 having a diameter e, diameter e being greater than diameter e. Diameter d may be for example 5 mm smaller than diameter e, so that a 2.5 mm ledge is bridged by sloped or chamfered section 39. First section 37 may also be stepped and have multiple diameters less than diameter e. A groove 40 may be cut into the cylinder 16, at which air holes 41, 42, 43 present themselves for providing air pressure to aid in removing or placing a sleeve 50 over blanket cylinder 16. It should be understood that more than 3 holes, for example 8 holes, extend around the entire circumference of groove 40. Moreover, the holes need not have a circular cross-section but may have a rectangular or a non-circular cross-section. Holes 41, 42, 43 however may be present directly at surface 38.

Sound-damping material 18 preferably contacts an inner surface of sleeve 50. However, this is not necessary. For example, with a 2.5 mm ledge between surface 38 and surface 37, both 3 mm thick or 2 mm thick sound-damping material may be used, with the 3 mm thick material providing contact. Contact is preferred, and may aid in removal and placement of the sleeve 50, since better air pressure is created by the air exiting holes 41, 42 and 43.

VELCRO hook section tape (as opposed to the loop section) has also been found to be a possible sound-damping material. Fleece-like material also may have applicability as sound-damping materials.

Figure 4:
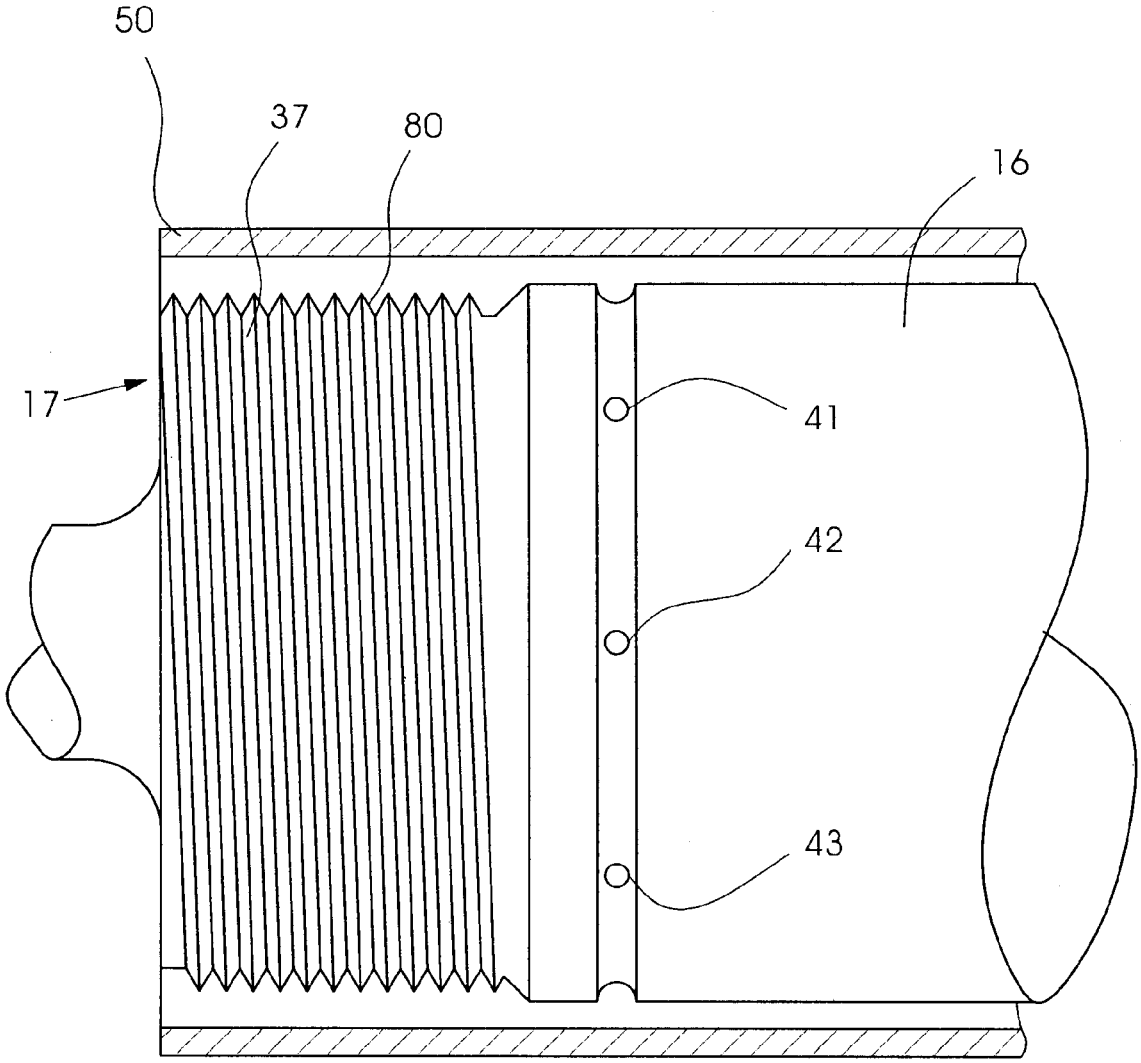
FIG. 4 shows an alternate embodiment of the printing press according to the present invention.

FIG. 4 shows an alternate embodiment of the present invention. Free end 17 of cylinder 16 may have a roughened sound-reducing section 80, which cause multiple reflections to break up noise emanating from the printing press when air escapes holes 41, 42, 43. Roughened sound-reducing section 80 preferably is created by forming a threads.

While the above embodiments have been described with respect to, and are particularly suited for, an offset printing press, it should be understood that the present invention may have advantages for all printing presses using axially removable sleeves.

What is claimed is:

1. A printing press comprising:

a cylinder having an outer surface and a plurality of air holes for providing air to the outer surface, the cylinder having a first end and a second end, the first end capable of being free, the outer surface having a sound-damping roughened section including threading, the roughened section being provided between the plurality of air holes and the first end; and an axially-removable printing sleeve for fitting over the first end, the sleeve having an interior, the sound-damping roughened section permitting the air from the plurality of air holes to pass over the sound-damping roughened section into the interior of the sleeve.

2. The printing press as recited in claim 1 wherein the roughened section is provided solely between the free end and the plurality of air holes.

3. A printing press comprising:

a cylinder having an outer surface, a plurality of air holes for providing air to the outer surface, and a free end, the outer surface having a roughened section, the roughened section being provided between the free end and the plurality of air holes; and an axially-removable printing sleeve for fitting over the outer surface.

4. The printing press as recited in claim 3 wherein the roughened section has a first diameter, and the outer surface also has a second section having a second diameter, the first diameter being smaller than the second diameter.

5. The printing press as recited in claim 3 wherein the roughened section is threaded.

6. The printing press as recited in claim 3 wherein the roughened section is provided solely between the free end and the plurality of air holes.

7. A printing press comprising:

a cylinder having an outer surface and a plurality of air holes for providing air to the outer surface, the cylinder having a first end and a second end, the first end capable of being free, the outer surface having a sound-damping roughened section between the plurality of air holes and the first end; and an axially-removable printing sleeve for fitting over the first end, the sleeve having an interior, the sound-damping roughened section permitting the air from the plurality of air holes to pass over the sound-damping roughened section into the interior of the sleeve.

8. The printing press as recited in claim 7 wherein the roughened section is provided solely between the free end and the plurality of air holes.

* * * * *